US006824939B2

(12) United States Patent
Kurimoto et al.

(10) Patent No.: US 6,824,939 B2
(45) Date of Patent: Nov. 30, 2004

(54) ELECTROPHOTOGRAPHIC IMAGE FORMING METHOD AND APPARATUS

(75) Inventors: Eiji Kurimoto, Numazu (JP); Ryohichi Kitajima, Numazu (JP); Takaaki Ikegami, Susono (JP); Yoshiaki Kawasaki, Susono (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 10/315,935

(22) Filed: Dec. 11, 2002

(65) Prior Publication Data

US 2003/0206226 A1 Nov. 6, 2003

(30) Foreign Application Priority Data

Dec. 11, 2001 (JP) ..... 2001-376852

(51) Int. Cl.[7] ..... G03G 15/04

(52) U.S. Cl. ..... 430/66; 430/58.85; 430/60; 347/132; 399/162

(58) Field of Search ..... 430/58.85, 59.3, 430/60, 66; 399/162; 347/132

(56) References Cited

U.S. PATENT DOCUMENTS

| | | | | |
|---|---|---|---|---|
| 4,123,269 | A | 10/1978 | Von Hoene et al. | |
| 4,740,441 | A | 4/1988 | Otomura | |
| 4,942,104 | A | 7/1990 | Kitajima et al. | |
| 5,339,138 | A | 8/1994 | Mishima et al. | |
| 5,411,827 | A | 5/1995 | Tamura et al. | |
| 5,496,671 | A | 3/1996 | Tamura et al. | |
| 5,578,405 | A | 11/1996 | Ikegami et al. | |
| 5,702,855 | A | 12/1997 | Ikegami et al. | |
| 6,030,736 | A | 2/2000 | Ikegami et al. | |
| 6,319,878 | B1 | 11/2001 | Ina et al. | |
| 6,326,112 | B1 | 12/2001 | Tamura et al. | |
| 6,432,596 | B2 | 8/2002 | Ikuno et al. | |
| 6,444,387 | B2 | 9/2002 | Ri et al. | |
| 6,455,206 | B1 * | 9/2002 | Hasegawa et al. | 430/7 |
| 6,492,079 | B2 | 12/2002 | Shimada et al. | |
| 6,548,216 | B2 * | 4/2003 | Kawamura et al. | 430/59.6 |

FOREIGN PATENT DOCUMENTS

| | | |
|---|---|---|
| JP | 48-37149 | 6/1973 |
| JP | 51-94829 | 8/1976 |
| JP | 52-139065 | 11/1977 |
| JP | 52-139066 | 11/1977 |
| JP | 54-58445 | 5/1979 |
| JP | 55-52063 | 4/1980 |
| JP | 55-154955 | 12/1980 |
| JP | 55-156954 | 12/1980 |
| JP | 56-29245 | 3/1981 |
| JP | 56-81850 | 7/1981 |
| JP | 58-58552 | 4/1983 |
| JP | 58-198043 | 11/1983 |
| JP | 58-198425 | 11/1983 |
| JP | 1-205171 | 8/1989 |
| JP | 3-285960 | 12/1991 |
| JP | 4-230764 | 8/1992 |
| JP | 7-333881 | 12/1995 |
| JP | 8-15887 | 1/1996 |
| JP | 8-123053 | 5/1996 |
| JP | 8-146641 | 6/1996 |
| JP | 8-179542 | 7/1996 |
| JP | 2002/202621 | 7/2002 |

* cited by examiner

*Primary Examiner*—John L Goodrow
(74) *Attorney, Agent, or Firm*—Oblon, Spivak, McClelland, Maier & Neustadt, P.C.

(57) ABSTRACT

An image forming apparatus including a photoreceptor which includes an electroconductive substrate, a photosensitive layer including a charge generation material and a charge transport material and located overlying the electroconductive substrate, and a protective layer including an inorganic filler having an average particle diameter (d) and a binder resin; and an imagewise light irradiator configured to irradiate the photoreceptor with a laser light beam having a wavelength of ($\lambda$) to form a light spot having a diameter (L) in the minor axis direction thereof on a surface of the photoreceptor, wherein the relationship $0.1<3.75\times10^{-3}L/\lambda<d/\lambda<0.5$ is satisfied. An image forming method is also provided which includes irradiating a surface of the photoreceptor with a laser beam such that the above-mentioned relationship is satisfied.

22 Claims, 3 Drawing Sheets

ELECTROPHOTOGRAPHIC IMAGE FORMING METHOD AND APPARATUS

BACKGROUND OF THE INVENTION

1. Field of the Invention

The present invention relates to an image forming apparatus utilizing electrophotography, such as copiers, printers, plotters and printing machines. More particularly, the present invention relates to an image forming apparatus in which an electrostatic latent image is formed on the photoreceptor by irradiating a photoreceptor with a light beam to form a light spot thereon. In addition, the present invention also relates to an electrophotographic image forming method.

2. Discussion of the Background

Various electrophotographic image forming apparatus have been developed and practically used. Electrophotographic image forming apparatus typically include the following processes:

(1) a photoreceptor serving as an image bearing member is charged in a dark place (charging process);

(2) an imagewise light irradiates the charged photoreceptor to selectively decay the charge of the lighted portion of the photoreceptor, resulting in formation of an electrostatic latent image on the photoreceptor (light irradiation process);

(3) the electrostatic latent image is developed with a toner including a colorant such as dyes and pigments and a binder resin such as polymers to from a toner image on the photoreceptor (developing process);

(4) the toner image is transferred onto a receiving material optionally via an intermediate transfer medium (image transfer process);

(5) the toner image formed on the receiving material is fixed upon application of heat and/or pressure thereto (fixing process); and (6) the surface of the photoreceptor is cleaned with a cleaner after the image transfer process to remove the toner particles remaining on the surface of the photoreceptor (cleaning process).

A photoreceptor used for electrophotography is required to have the following properties:

(1) good charging ability such that the photoreceptor is charged so as to have and maintain a proper electric potential in a dark place;

(2) good charge maintaining ability such that the charges formed thereon hardly decay in a dark place; and (3) good charge decaying ability such that when the photoreceptor is exposed to imagewise light, the charges of the lighted area rapidly decay and the residual potential thereof is low.

Among these electrophotographic image forming apparatus, digital image forming apparatus in which a laser beam irradiates a photoreceptor to form an electrostatic latent image on the photoreceptor are mainstream now. The digital image forming apparatus are practically used as laser printers, digital copiers and the like apparatus.

The light irradiating process of such digital image forming apparatus typically includes the following subprocesses:

(1) the light output by a laser diode (hereinafter sometimes referred to as a LD) is modulated with digital image data;

(2) the surface of the photoreceptor is raster-scanned with the light beam (i.e., a light spot) emitted from the LD (when a photoreceptor drum is used, the photoreceptor drum is rotated (i.e., the raster-scanning is performed) in a direction perpendicular to the main scanning direction of the light beam), resulting in formation of a dotted electrostatic latent image on the photoreceptor.

In addition, electrophotographic image forming apparatus are currently required to fulfill the following requisites:

(1) to produce high quality images at a high speed;

(2) to be small in size; and (3) the photoreceptor used thereof has to have a high durability because the photoreceptor has a relatively small diameter compared to conventional photoreceptors.

In general, the life of an electrophotographic image forming apparatus typically depends on the life of the photoreceptor used therefor. This is because the photoreceptor deteriorates relatively seriously compared to other members used for the image forming apparatus since the photoreceptor repeatedly suffers mechanical stresses and chemical stresses in the charging, light irradiating, developing, transferring and cleaning processes.

A photoreceptor is mechanically deteriorated by abrasion and scratches of the surface of the photoreceptor, and is chemically deteriorated by oxidation of the binder resin and the charge transport material included in the photoreceptor due to ozone generated during the charging process and deposition of foreign materials on the surface of the photoreceptor. The mechanical and chemical deterioration of the photoreceptor causes deterioration of image qualities.

As the image forming speed increases and the image forming apparatus is miniaturized, the diameter of the photoreceptor drum is decreased, and thereby the usage conditions of the photoreceptor drum become severer and severer. In particular, in order to well clean the surface of the photoreceptor, a blade made of a hard rubber is used for the cleaner and in addition the contact pressure of the rubber blade with the photoreceptor has to be increased. Therefore, the abrasion of the surface of the photoreceptor is accelerated, resulting in variation of the electric potential and photosensitivity of the photoreceptor. Thereby, problems such that abnormal images are produced; and color balance of produced color images deteriorates, resulting in deterioration of color reproducibility of the color images.

In attempting to improve the abrasion resistance of a photoreceptor, a method in which the photosensitive layer is thickened is proposed and performed. However, when the thickness of a charge transport layer of a multi-layered photosensitive layer, which is typically overlaid on a charge generation layer and which transports the charge generated in the charge generation layer, is increased, the charge moving through the charge transport layer tends to scatter, resulting in increase of the width of electrostatic latent images, and thereby the resolution of the resultant images deteriorates.

In attempting to improve the abrasion resistance of a photoreceptor, a method in which a protective layer is formed on a photosensitive layer or another method in which an inorganic filler is included in a photosensitive layer have been proposed in, for example, published Japanese Patent Applications Nos. 1-205171, 7-333881, 8-15887, 8-123053 and 8-146641. As a result of our experiments, these methods have a drawback in that the area of the photoreceptor lighted by imagewise light gradually increases after repeated use, resulting in deterioration of image qualities such as decrease of the image density, although the abrasion resistance of the photoreceptor can be improved by these methods.

In attempting to remedy the drawback, a protective layer in which a particulate metal oxide is dispersed in a protective layer is proposed in published Japanese Patent Application No. 8-179542.

Although the conventional photoreceptors having a protective layer have good mechanical strength and abrasion resistance but have a drawback in that the resolution of the resultant images deteriorates (the developed toner images widens) due to scattering of the imagewise light in the protective layer.

In addition, it is well know from the above-mentioned background art that in the laser printers and digital copiers in which a laser beam emitted by a LD irradiates a photoreceptor, the particle diameter of the filler included in the protective layer of the photoreceptor is preferably less than the wavelength of the laser light to suppress the scattering of the laser light. However, when the particle diameter of the filler is merely decreased, problems in that the abrasion resistance of the photoreceptor is not improved, and fine line reproducibility of the photoreceptor deteriorates due to diffuse reflection of the laser light on the rough surface of the photoreceptor tend to occur, although scattering of the laser light can be prevented.

Because of these reasons, a need exists for a highly durable electrophotographic image forming apparatus which uses a photoreceptor including a protective layer including a filler and which can produce high quality images for a long period of time without causing deterioration of the image resolution due to scattering or diffuse reflection of the laser light used as the imagewise light.

SUMMARY OF THE INVENTION

Accordingly, an object of the present invention is to provide a highly durable electrophotographic image forming apparatus which uses a photoreceptor including a protective layer including a particulate metal oxide filler and which can produce high quality images for a long period of time without causing deterioration of the image resolution due to scattering or diffuse reflection of the laser light used as the imagewise light.

Briefly this object and other objects of the present invention as hereinafter will become more readily apparent can be attained by an image forming apparatus including:

a photoreceptor which serves as an image bearer and which includes an electroconductive substrate, a photosensitive layer including a charge generation material and a charge transport material and located overlying the electroconductive substrate, and a protective layer including an inorganic filler having an average particle diameter (d) and a binder resin;

an imagewise light irradiating device configured to irradiate the photoreceptor with a laser light beam having a wavelength of (λ) while scanning the laser light beam to form light spots each having a diameter (L) in the minor axis direction thereof on the surface of the photoreceptor and to form a latent image on the photoreceptor, wherein the following relationship is satisfied:

$$0.1<3.75\times10^{-3}L/\lambda<d/\lambda<0.5.$$

The inorganic filler included in the protective layer preferably has an average particle diameter of from 0.2 to 0.4 μm.

The diameter (L) of the light spot in the minor axis direction is preferably from 10 to 80 μm.

It is preferable that the protective layer further includes a charge transport material.

The photosensitive layer preferably is a multi-layered photosensitive layer in which a charge generation layer including the charge generation material and a charge transport layer including the charge transport material are overlaid.

The filler included in the protective layer is preferably a material selected from the group consisting of titanium oxide, silica, alumina and mixtures thereof.

The wavelength of the laser light beam is preferably a wavelength of from 400 to 450 nm.

The image forming apparatus can include a process cartridge including the photoreceptor and at least one of a charger configured to charge the photoreceptor; an image developer configured to develop the electrostatic latent image with a developer including a toner to form a toner image on the photoreceptor; and a cleaner configured to clean the surface of the photoreceptor (i.e., to remove the residual toner from the surface of the photoreceptor).

In the another aspect of the present invention, an image forming method is provided which includes the steps of:

irradiating a surface of photoreceptor with a laser light beam having a wavelength of (λ) to form a light spot having a diameter (L) in the minor axis direction thereof on the surface of the photoreceptor, wherein the photoreceptor includes an electroconductive substrate, a photosensitive layer including a charge generation material and a charge transport material and located overlying the electroconductive substrate, and a protective layer comprising an inorganic filler having an average particle diameter (d) and a binder resin, and wherein the following relationship is satisfied:

$$0.1<3.75\times10^{-3}L/\lambda<d/\lambda<0.5.$$

In the present application, the diameter of a spot of a laser beam is defined as follows. The light intensity of a laser beam spot has a Gaussian distribution. The diameter of a light spot is defined as a diameter of a circle (or an ellipse) at which the light intensity of the laser light is $1/e^2$ of the maximum light intensity of the laser beam spot, wherein e represents Euler's constant (i.e., 2.718). When the light spot has an ellipse form, the minor axis diameter of the ellipse is defined as the diameter of the light spot.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
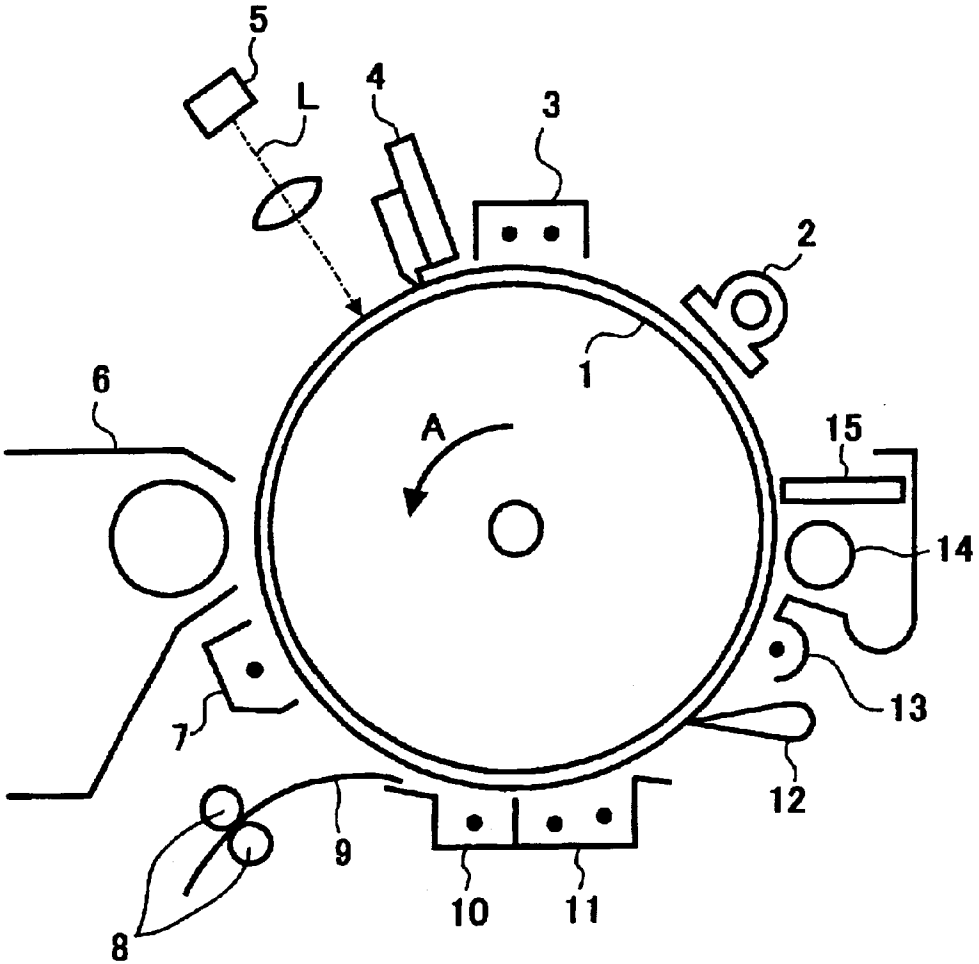
FIG. 1 is a schematic view illustrating the image forming section of an embodiment of the image forming apparatus of the present invention.

The present invention relates to an image forming apparatus including a photoreceptor and an imagewise light irradiating device which scans a light beam to form light spots on the surface of the photoreceptor. In order to produce high quality images while the photoreceptor used in the image forming apparatus has a long life and a high reliability, the physical properties and the light irradiating conditions of the image forming apparatus have to be optimized.

The photoreceptor for use in the image forming apparatus of the present invention includes an electroconductive substrate, a photosensitive layer which is located overlying the electroconductive substrate and which includes a charge generation material and a charge transport material, and a protective layer which is an uppermost layer of the photoreceptor and which includes a binder resin and an inorganic filler dispersed in the binder resin, wherein the inorganic filler is included in the protective layer to improve the abrasion resistance of the photoreceptor.

In the present invention, when the average particle diameter (d), the wavelength (λ) of the laser beam used for forming light spots on the photoreceptor, and the diameter (L) of the light spots in the minor axis direction thereof (hereinafter referred to as the minor axis diameter) have the specific relationship mentioned below, high quality images (electrostatic images and toner images) can be formed on the photoreceptor while the photoreceptor has good abrasion resistance. This is because the problem in that charges to be transferred through the photosensitive layer scatter, resulting in deterioration of resolution of the resultant electrostatic latent images can be prevented. In this case, since the light spots typically has a circular form or an elliptic form, the diameter of the light spots means the diameter in the minor axis direction of the light spots. In addition, when the diameter of the light spots is changed by, for example, a power modulation, the diameter means the maximum diameter of the light spots (i.e., the diameter of the full dots).

Specifically the specific relationship is the following relationship (1):

$$0.1<3.75\times10^{-3}L/<d/\lambda<0.5 \quad (1)$$

wherein d represents the average particle diameter of the inorganic filler included in the protective layer; λ represents the wavelength of the laser beam used for forming light spots on the photoreceptor; and L represents the diameter of the light spots in the minor axis direction thereof.

This relationship is based on the following knowledge. The ratio of the minor axis diameter of light spots to the wavelength of the laser beam used for forming the light spots on the photoreceptor, i.e., the value of $3.75\times10^{-3}L/\lambda$, is not greater than 0.1, the laser light tends to randomly reflect at the surface of the photoreceptor due to rough surface of the photoreceptor, thereby deteriorating the fine line resolution of the resultant electrostatic latent image.

When the value of $3.75\times10^{-3}L/\lambda$ is greater than $d/\lambda$, the fine resolution of the resultant electrostatic latent image deteriorates, and in addition the abrasion amount of the photoreceptor increases, i.e., the photoreceptor has poor durability.

When the ratio of the minor axis diameter of the light spots to the wavelength of the laser beam, i.e., $d/\lambda$, is greater than 0.5, the residual potential of the area of the photoreceptor, which is exposed to the laser beam, increases (i.e., the potential of the lighted portion of the photoreceptor increases), resulting in decrease of image density.

Therefore, when an image forming apparatus satisfying the relationship (1), the image forming apparatus can produce high quality images while the photoreceptor used therefor has good durability. Thus, a highly reliable image forming apparatus can be provided.

The inorganic filler included in the protective layer of the photoreceptor preferably has an average particle diameter (d) of from 0.2 to 0.4 μm so that the resultant photoreceptor has good abrasion resistance and can produce high quality images. When the average particle diameter (d) is too large, sharp latent images cannot be formed on the photoreceptor. In addition, the inorganic filler tends to serve as charge traps during the charge transporting process, resulting in deterioration of light decaying properties of the photoreceptor, e.g., increase of the residual potential.

In contrast, the average particle diameter (d) is too small, the abrasion resistance of the photoreceptor deteriorates. Specifically, when the average particle diameter (d) is too small, the bond of the filler with the binder resin in the protective layer is weakened, and thereby the filler tends to be released from the protective layer. Therefore the photoreceptor is easily abraded, resulting in shortening of the life of the photoreceptor. In addition, when the average particle diameter (d) of the filler is too small, the filler tends to coagulate in a protective layer coating liquid, and thereby a uniform protective layer cannot be formed. Thus, the average particle diameter (d) of the inorganic filler is preferably from 0.2 to 0.4 μm.

The minor axis diameter (L) of the light spots formed on the photoreceptor is preferably from 10 to 80 μm. The light spot diameter has a large influence on the image qualities. Laser beam for use in imagewise light irradiation has a characteristic such that the shorter wavelength a laser beam has, the smaller diffraction the beam has, and therefore the waist of the laser beam can be narrowed when the laser beam has a short wavelength. Therefore, when a laser beam having a short wavelength is used as imagewise light, the light spot formed on the photoreceptor can be miniaturized. Therefore, when a laser beam having a short wavelength is used and the inorganic filler included in the protective layer has the desired average particle diameter mentioned above (i.e., 0.2 to 0.4 μm), the upper limit of the minor axis diameter of the light spot is about 80 μm. Since the smaller the light spot diameter, the higher resolution the latent image has, the minor axis diameter of the light spot is preferably not greater than 60 μm, and more preferably not greater than 40 μm.

In general, the smaller the light spot diameter, the better the resolution of the resultant latent image, and therefore the half tone properties of highlight portions can be improved. However, since the particle diameter of toners has a lower limit, the image qualities cannot be further improved if the light spot diameter is too small compared to the particle diameter of the toner used. In addition, when the light spot diameter is too small, the light is easily influenced by the surface of the photoreceptor used if the surface is roughened. In view of these points, the lower limit of the minor axis diameter of the light spot is about 10 μm. Thus, the minor axis diameter of the light spot is preferably from about 10 to about 80 μm, more preferably from about 10 to 60 μm and even more preferably from about 10 to 40 μm.

As mentioned above, when a laser beam having a short wavelength is used, the beam waist can be narrowed (i.e., the diameter of the light spot can be shortened) because the laser light has a small diffraction. Specifically, the light spot diameter (L) satisfies the following relationship:

$$L\propto(\pi/4)(\lambda f/D)$$

wherein λ represents the wavelength of the laser beam, f represents a focal length of the fθ lens used, and D represents the diameter of the lens.

As can be under stood from the relationship, the smaller the parameters λ and f and/or the larger the parameter D, the smaller the light spot diameter. However, when it is desired to decrease the light spot diameter L so as to be from 10 to 15 μm, the parameter f should be made smaller and/or the parameter D is made larger, and therefore an ultra-highly precise optical part and/or a large lens are needed. In addition, these parts have high costs. Therefore it is impossible to use these parts for practical image forming apparatus because the apparatus have high manufacturing costs and become large in size. Therefore, it is very effective to make the wavelength λ smaller. In view of this point, a blue laser having a wavelength of from 400 to 450 nm is preferably used as the laser light to make the light spot smaller i.e., to enhance the image resolution. In addition, such a laser beam is preferably used to decrease the manufacturing costs of the image forming apparatus and miniaturize the image forming apparatus.

In the present invention, the protective layer preferably includes a charge transport material to accelerate the charge transportability of the photoreceptor, resulting in enhancement of the photosensitivity of the photoreceptor.

In addition, by functionally separating the photosensitive layer, i.e., by forming a multi-layer photosensitive layer in which a charge generation layer and a charge transport layer are overlaid, the photosensitivity of the resultant photoreceptor can be enhanced.

Further, by using a material selected from the group consisting of titanium oxide, silica, alumina and mixtures thereof as the inorganic filler in the protective layer, excellent abrasion resistance can be imparted to the resultant photoreceptor.

The image forming apparatus of the present invention will be explained referring to drawings.

At first, the photoreceptor for use in the image forming apparatus of the present invention will be explained.

The photoreceptor includes an electroconductive substrate, a photosensitive layer including a charge generation material and a charge transport material, and a protective layer including an inorganic filler and a binder resin, wherein the photosensitive layer and the protective layer are overlaid on the electroconductive substrate.

Suitable materials for use as the electroconductive substrate include electroconductive materials, and insulating materials which are treated with an electroconductive material. Specific examples of the electroconductive materials include metals such as Al, Fe, Cu and Au; and metal alloys of such metals. Specific examples of the insulating materials which are treated with an electroconductive material include materials which are prepared by treating an insulator such as polyesters, polycarbonates, polyimides, paper and glass with a metal such as Al, Ag and Au or an electroconductive material such as $In_2O_3$ and $SnO_2$.

The form of the electroconductive substrate is not particularly limited, and plate-form, drum-form or belt-form electroconductive substrates can also be used.

Next, the photosensitive layer will be explained.

The photosensitive layer of the photoreceptor for use in the present invention may be a single-layered photosensitive layer or a multi-layered photosensitive layer.

At first, the functionally separated multi-layered photosensitive layer in which a charge generation layer and a charge transport layer are overlaid will be explained.

The charge generation layer includes a charge generation material as a main component, and optionally includes a binder resin.

Specific examples of the inorganic charge generation materials include crystal selenium, amorphous selenium, selenium-tellurium compounds, selenium-tellurium-halogen compounds, selenium-arsenic compounds, amorphous silicon, etc. With respect to amorphous silicon, compounds in which the dangling bond is terminated with a hydrogen atom or a halogen atom or in which a boron atom or a phosphorous atom is doped can be preferably used.

Suitable organic charge generation materials include known organic charge generation materials. Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials. These charge generation materials can be used alone or in combination.

Among the charge generation materials, disazo pigments having the following formula (1) are preferably used because of having high charge generation efficiency (i.e., high photosensitivity):

(1)

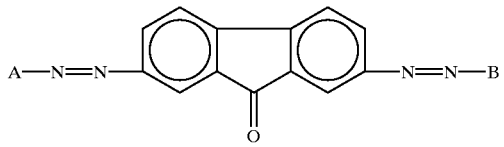

wherein A and B independently represent a residual group of the coupler used, which has a formula selected from the following formulae (2) to (8).

(2)

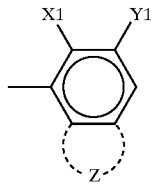

wherein X1 represents —OH, —$NHCOCH_3$, or —$NHSO_2CH_3$; Y1 represents —CON (R2) (R3), —CONHN=C (R6) (R7), —CONHN (R8) (R9), —CONHCONH (R12), a hydrogen atom, —COOH, —$COOCH_3$, —$COOC_6H_5$ or a benzimidazolyl group, wherein R2 and R3 independently represent a hydrogen atom, a substituted or unsubstituted alkyl group, a substituted or unsubstituted aryl group, a substituted or unsubstituted heterocyclic ring group, and R2 and R3 optionally share bond connectivity with the adjacent nitrogen atom to form a ring, R6 and R7 independently represent a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R6 and R7 optionally share bond connectivity with the adjacent carbon atom to form a ring, R8 and R9 independently represents a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R8 and R9 optionally share bond connectivity to form a 5-member or 6-member ring which optionally includes a condensed aromatic ring, and R12 represents a substituted or unsubstituted alkyl group, a substituted or unsubstituted aryl group or a substituted or unsubstituted heterocyclic ring group; and Z represents a group which shares bond connectivity with a benzene ring to form a polycyclic aromatic ring or a polycyclic heterocyclic ring such as naphthalene ring, an anthracene ring, a carbazole ring, a dibenzocarbazole group, a dibenzofuran ring, a benzonaththofuran ring and a dibenzothiophene ring, wherein the rings optionally include a substituent.

(3)

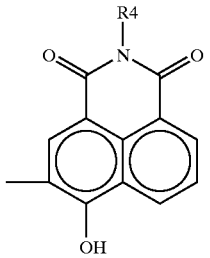

wherein R4 represents a hydrogen atom, a substituted or unsubstituted alkyl group, or a substituted or unsubstituted aryl group.

(4)

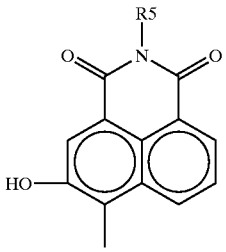

wherein R5 represents a hydrogen atom, a substituted or unsubstituted alkyl group, or a substituted or unsubstituted aryl group.

(5)

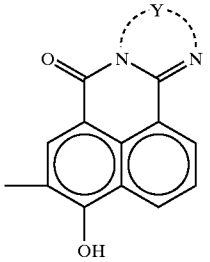

wherein Y represents a divalent aromatic hydrocarbon group or a divalent heterocyclic ring group having a nitrogen atom in the ring.

(6)

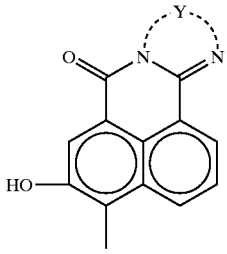

wherein Y represents a divalent aromatic hydrocarbon group or a divalent heterocyclic ring group having a nitrogen atom in the ring.

(7)

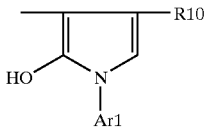

wherein R10 represents a hydrogen atom, an alkyl group having from 1 to 8 carbon atoms, a carboxyl group, or a carboxyl ester group; and Ar1 represents a substituted or unsubstituted aromatic hydrocarbon ring group.

(8)

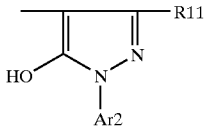

wherein R11 represents a hydrogen atom, an alkyl group having from 1 to 8 carbon atoms, a carboxyl group, or a carboxyl ester group; and Ar2 represents a substituted or unsubstituted aromatic hydrocarbon ring group.

As the substituted alkyl group, which is optionally included in the above-mentioned charge generation materials, linear or branched alkyl groups having from 1 to 12 carbon atoms, which may be substituted with a halogen atom, a hydroxyl group, a cyano group, an alkoxyl group having from 1 to 4 carbon atoms and/or a phenyl group optionally substituted with an alkyl group or an alkoxyl group having from 1 to 4 carbon atoms, can be exemplified. Specific examples thereof include a methyl group, an ethyl group, a n-propyl group, an isopropyl group, a tert-butyl group, a sec-butyl group, a n-butyl group, an iso-butyl group, a hexyl group, an undecanyl group, a trifluoromethyl group, a 2-hydroxyethyl group, a 2-cyanoethyl group, a 2-ethoxyethyl group, a 2-methoxyethyl group, a benzyl group, a 4-chlorobenzyl group, a 4-methylbenzyl group, a 4-methoxybenzyl group, a 4-phenylbenzyl group, a cyclohexyl group and the like.

As the substituted aryl group, which is optionally included in the above-mentioned charge generation materials, groups of aromatic hydrocarbons such as benzene, naphthalene, anthracene and pyrene; and groups of aromatic heterocyclic rings such as pyridine, quinoline, thiophene, furan, oxazole, oxadiazole, carbazole and the like. These rings can be substituted by one or more of the following substituents.

(1) halogen atoms, a cyano group, and a nitro group.

(2) linear or branched alkyl groups having from 1 to 12 carbon atoms, which optionally substituted with a halogen atom, a hydroxyl group, a cyano group, an alkoxyl group having from 1 to 4 carbon atoms and/or a phenyl group optionally substituted with an alkyl group or an alkoxyl group having from 1 to 4 carbon atoms. Specific examples thereof are mentioned above.

(3) alkoxyl groups (i.e., —OR). Specific examples of R include the alkyl groups mentioned above. Specific examples of the alkoxyl groups include a methoxy group, an ethoxy group, a n-propoxy group, an isopropoxy group, a tert-butoxy group, a n-butoxy group, a sec-butoxy group, an iso-butoxy group, a 2-hydroxyethoxy group, a 2-cyanoethoxy group, a benzyloxy group, a 4-methylbenzyloxy group, a trifluoromethoxy group and the like group.

(4) aryloxy groups such as a phenoxy group and a naphthyloxy group, which may be substituted with an alkyl group having from 1 to 4 carbon atoms and/or a halogen atom. Specific examples thereof include a phenoxy group, a 1-naphthyloxy group, a 2-naphthyloxy group, a 4-methylphenoxy group, a 4-methoxyphenoxy group, a 4-chlorophenoxy group, a 6-methyl-2-naphthyloxy group, and the like group.

(5) alkylmercapto groups (—SR). Specific examples of R include the alkyl groups mentioned above. Specific examples of the alkylmercapto group include a methylthio group, an ethylthio group, a phenylthio group, a p-methylphenylthio group, and the like groups.

Specific examples of the substituted aryl groups include a p-tolyl group, a 4-tert-butylphenyl group, a 4-chlorophenyl group, a 4-phenoxyphenyl group, a 3-ethylthiophenyl group, a 4'-methylbiphenyl-4-yl group, a 6-tert-butyl-1-pyrenyl group, a 4-methyl-1-naphthyl group, a 9,9-dimethyl-2-fluorenyl group, a 2,6-dimethylpyridyl group, a 6-methoxy-9-carbazolyl group, a 4,7-dimethylbenzofuranyl group and the like groups.

As the substituted heterocyclic ring groups, which is optionally included in the above-mentioned charge generation materials, a pyrrodinyl group, a piperidinyl group, a pyrrolinyl group, a N-methyl carbazolyl group, a N-ethyl carbazolyl group, a N-phenylcarbazolyl group, an indolyl group, a quinolyl group and the like groups.

As the substituted aralkyl groups, groups (Ar—R—) in which Ar is one of the aryl groups and the substituted aryl groups mentioned above and R is one of divalent groups of the alkyl groups and substituted alkyl groups mentioned above.

As the substituted styryl group, groups similar to the aralkyl groups can be exemplified.

Specific examples of the binder resin, which is optionally used in the charge generation layer, include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These materials can be used alone or in combination. In addition, the charge generation layer may include a charge transport material, specific examples of which are mentioned below.

Suitable methods for forming the charge generation layer include thin film forming methods performed in vacuum, and casting methods in which a solution or dispersion of a charge generation material is coated.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. By using one of these methods and one or more of the above-mentioned inorganic and organic materials, a good charge generation layer can be formed.

The casting methods useful for forming the charge generation layer include, for example, the following steps:

(1) preparing a coating liquid by mixing one or more inorganic and organic charge generation materials mentioned above with a solvent such as tetrahydrofuran, cyclohexanone, dioxane, dichloroethane, butanone and the like, optionally together with a binder resin and an additives, and then dispersing the materials using a ball mill, an attritor, a sand mill or the like dispersing machine;

(2) coating on a substrate the coating liquid, which may be diluted as necessary, using a dip coating method, a spray coating method, a bead coating method, a nozzle coating method, a spinner coating method, a ring coating method or the like method; and (3) drying the coated liquid to form a charge generation layer.

The thickness of the charge generation layer is preferably from about 0.01 to about 5 $\mu$m, and more preferably from about 0.05 to about 2 $\mu$m.

Then the charge transport layer will be explained.

The charge transport layer is typically prepared by, for example, the following method:

(1) preparing a coating liquid by dissolving a binder resin and one or more charge transport materials mentioned below in a solvent such as tetrahydrofuran, cyclohexanone, dioxane, dichloroethane, butanone and the like, optionally together with an additive;

(2) coating the coating liquid on a substrate using a dip coating method, a spray coating method, a bead coating method or the like method; and (3) drying the coated liquid to form a charge transport layer.

Specific examples of the binder resin include resins having good film formability, such as polycarbonate resins (e.g., bisphenol A form-, bisphenol Z form-, bisphenol C form-polycarbonate resins, and copolymers thereof), polyarylate resins, polysulfone resins, polyester resins, methacrylic resins, polystyrene resins, vinyl acetate resins, epoxy resins, phenoxy resins and the like resins. These resins are used alone or in combination.

Specific examples of the charge transport materials include oxazole derivatives and oxadiazole derivatives (e.g., materials disclosed in published Japanese Patent Applications Nos. 52-139065 and 52-139066); imidazole derivatives and triphenyl amine derivatives (e.g., materials disclosed in published Japanese Patent Application No.-3-285960); benzidine derivatives (e.g., materials disclosed in Japanese Patent Publication No. 58-32372 (i.e., published Japanese Patent Application No. 54-58445)); $\alpha$-phenylstilbene derivatives (e.g., materials disclosed in published Japanese Patent Application No. 58-198425); hydrazone derivatives (e.g., materials disclosed in published Japanese Patent Applications Nos. 55-154955, 55-156954, 55-52063 and 56-81850); triphenyl methane derivatives (e.g., materials disclosed in Japanese Patent Publication No. 51-10983 (i.e., published Japanese Patent Application No. 48-37149)); anthracene derivatives (e.g., materials disclosed in published Japanese Patent Application No. 51-94829); styryl derivatives (e.g., materials disclosed in published Japanese Patent Applications Nos. 56-29245 and 58-198043); carbazole derivatives (e.g., materials disclosed in published Japanese Patent Application No. 58-58552);

and pyrene derivatives (e.g., materials disclosed in published Japanese Patent Application No. 4-230764).

Among these charge transport materials, charge transport materials having the following formula (9) are preferably used because of having good charge transport properties (i.e., high photo-response or high sensitivity).

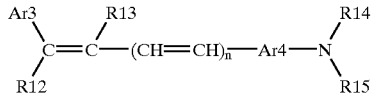

(9)

wherein R12, R13, R14 and R15 independently represent a hydrogen atom, a substituted or unsubstituted alkyl group having from 1 to 8 carbon atoms or a substituted or unsubstituted aryl group; Ar3 represents a substituted or unsubstituted aryl group; Ar4 represents a substituted or unsubstituted arylene group, wherein Ar3 and R12 optionally share bond connectivity to form a ring; and n is 0 or 1.

Specific examples of the substituted alkyl group and the substituted aryl groups include the groups mentioned above for use in the charge generation materials.

Specific examples of the arylene group include divalent groups of the aryl groups mentioned above.

The thickness of the charge transport layer is preferably from 5 to 100 $\mu$m and more preferably from 10 to 30 $\mu$m.

Then the single-layered photosensitive layer will be explained.

The single-layered photosensitive layer is typically prepared by, for example, the following casting method:

(1) preparing a coating liquid by mixing one or more of the charge generation materials mentioned above, one or more of the charge transport materials mentioned above and a binder resin in a solvent, optionally together with an additive such as plasticizers and leveling agents;

(2) coating the coating liquid on an electroconductive substrate; and (3) drying the coated liquid to form a single-layered photosensitive layer.

The thickness of the single-layered photosensitive layer is from 5 to 100 $\mu$m, and preferably from 10 to 30 $\mu$m.

In any of the photosensitive layers mentioned above, it is preferable that a disazo pigment, which has one of the formulae mentioned above, or Y-form oxytitanyl phthalocyanine is used as the charge generation material and a charge transport material having the specific formula mentioned above is used as the charge transport material, to prepare a photoreceptor which can be used for high speed image forming processes.

Next, the protective layer will be explained.

The protective layer of the photoreceptor for use in the image forming apparatus of the present invention includes an inorganic filler and a binder resin as main components.

Specific examples of the inorganic filler include titanium oxide, silica, alumina, zirconium oxide, indium oxide, silicon carbide, calcium oxide, zinc oxide, barium sulfate, etc.

The surface of these inorganic fillers may be treated with an inorganic or organic material to impart good dispersibility to the fillers. Specific examples of such treatments include water-repellent treatments using a silane coupling agent, a fluorine-containing silane coupling agent, a higher fatty acid or the like material. Specific examples of the inorganic material for use the surface treatments include alumina, zirconia, tin oxide, silica, etc.

Among the inorganic fillers, titanium oxide, silica and alumina are preferably used because of imparting good abrasion resistance and electrostatic properties to the resultant photoreceptor. Therefore it is preferable to use such an inorganic filler in the protective layer of the photoreceptor for use in the image forming apparatus of the present invention.

In particular, $\alpha$-alumina is more preferably used in the protective layer because of imparting excellent durability to the resultant photoreceptor. This is because $\alpha$-alumina has a high Mohs hardness following diamond and a high transparency. Since $\alpha$-alumina is very hard, to include $\alpha$-alumina in a photoreceptor is very effective measure to improve the durability of the photoreceptor. Since $\alpha$-alumina is transparent, the layer including the filler can efficiently transmit imagewise light and thereby good charge properties can be imparted to the photoreceptor. Thus, by including $\alpha$-alumina in the protective layer, the properties of the photoreceptor can be improved as a whole.

Among $\alpha$-alumina, the $\alpha$-alumina mentioned below is more preferably used because the filler has good packing property in a film (i.e., in the protective layer). Therefore, even when the content of the filler is increased, the resultant layer (film) has smooth surface.

Specifically, it is preferable to use the $\alpha$-alumina which is polyhedral particles substantially having no crush surface. In addition, the $\alpha$-alumina for use in the present invention preferably has a D/H ratio of from 0.5 to 5.0, wherein D represents a maximum particle diameter of the $\alpha$-alumina in a direction parallel to the hexagonal close-packed lattice plane; and H represents a maximum particle diameter of the $\alpha$-alumina in a direction vertical to the hexagonal close-packed lattice plane.

The protective layer is typically prepared by preparing a coating liquid which is prepared by dissolving or dispersing an inorganic filler and a binder resin, optionally together with a low molecular weight charge transport material and/or a charge transport polymer material, in a solvent; coating the coating liquid on the photosensitive layer; and drying the coated liquid.

Specific examples of the binder resins include acrylic resins, polyester resins, polycarbonate resins (bisphenol A form-, bisphenol Z form-, bisphenol C form-polycarbonate resins and copolymers thereof), polyarylate resins, polyamide resins, polyurethane resins, polystyrene resins, epoxy resins, etc.

The content of the inorganic filler in the protective layer is preferably from 3 to 50% by weight, and more preferably from 5 to 30% by weight. When the content is too low, the abrasion resistance of the resultant photoreceptor is not satisfactory. When the content is too high, the transparency of the protective layer (the photosensitive layer) deteriorates.

The inorganic filler in the protective layer preferably has an average particle diameter such that the following relationship (1) is satisfied:

$$0.1<3.75\times10^{-3}L/\lambda<d/\lambda<0.5 \quad (1)$$

Preferably the average particle diameter (d) is preferably from 0.2 to 0.4 $\mu$m to impart good abrasion resistance to the resultant photoreceptor and to produce high quality images.

When the average particle diameter (d) of the inorganic filler is too large, the electrostatic latent images formed on the photoreceptor become unclear, resulting in deterioration of the image qualities. In contrast, when the average particle diameter is too small, the bond of the filler with the binder resin in the protective layer is weakened, and thereby the filler tends to be released from the protective layer. Therefore the photoreceptor is easily abraded, resulting in shortening of the life of the photoreceptor. In addition, when the average particle diameter is too small, the filler is closely packed in the protective layer, and thereby the filler tends to serve as charge traps, resulting in deterioration of light decaying properties of the photoreceptor and increase of the residual potential thereof. Further, a problem in that the filler in a coating liquid tends to coagulate, resulting in formation of an uneven protective layer.

It is an important requirement for the protective layer that a filler is present in the protective layer at a constant content, to improve the abrasion resistance and image qualities. When such a protective layer is formed, the resultant photoreceptor has good high speed response and can produce high resolution images without deteriorating the photosensitivity and electrostatic properties. In order to fulfill the requirement, a filler area ratio of the area occupied by the filler in any cross section of the protective layer to the total area of the cross section is preferably from 2 to 6%. When the filler area ratio is too small, the abrasion resistance of the photoreceptor is not satisfactory. In contrast, when the ratio is too large, problems in that the residual potential increases; the photosensitivity deteriorates; the resolution of the images deteriorates; and abnormal images are produced due to toner film formation on the surface of the photoreceptor, tend to occur.

The filler area ratio can be controlled by controlling the particle diameter and particle diameter distribution of the filler material used, and optimizing the formula of the coating liquid and the coating conditions.

The filler is typically dispersed in a solvent such as tetrahydrofuran, cyclohexanone, dioxane, dichloromethane, dichloroethane, and butanone together with a binder resin to prepare a coating liquid. The coating liquid is coated by a coating method such as dip coating methods, spray coating methods and bead coating methods. Suitable binder resins include polycarbonate resins, polyarylate resins and mixtures thereof. By using such a resin as the binder resin, the resultant protective layer (i.e., the resultant photoreceptor) has excellent durability.

It is preferable that the charge transport material included in the protective layer has an ionization potential not greater than that of the charge transport material included in the photosensitive layer, so that the resultant photoreceptor has high speed response.

The photoreceptor for use in the image forming apparatus of the present invention may include an undercoat layer between the electroconductive substrate and the photosensitive layer. The undercoat layer typically includes a resin. Since the photosensitive layer is typically formed by coating a coating liquid including an organic solvent, the resin included in the undercoat layer preferably has good resistance to organic solvents. Specific examples of such resins include water-soluble resins such as polyvinyl alcohol, casein and sodium polyacrylate; alcohol soluble resins such as nylon copolymers and methoxymethylated nylons; and crosslinking resins, which can form a three-dimensional network, such as polyurethane resins, melamine resins, alkyd resins and epoxy resins.

In addition, the undercoat layer preferably includes a fine powder such as metal oxides (e.g., titanium oxide, silica, alumina, zirconium oxide, tin oxide and indium oxide), metal sulfide, and metal nitride to impart good charge stability to the resultant photoreceptor. The undercoat layer is typically formed by coating a coating liquid, which is prepared by dissolving or dispersing a resin and a filler in a solvent, on an electroconductive substrate using a proper coating method. The thickness of the undercoat layer is preferably from 0.1 to 20 $\mu$m, and more preferably from 0.5 to 10 $\mu$m.

Next, the image forming apparatus of the present invention will be explained referring to drawings.

FIG. 1 is a schematic view illustrating the image forming section of an embodiment of the image forming apparatus of the present invention.

The image forming members and processes are explained referring to FIG. 1. As shown in FIG. 1, an image is formed on a receiving material after performing typical electrophotographic image forming processes, i.e., charging, light irradiating, developing, and transferring.

Numeral 1 denotes a photoreceptor which is drum-shaped. However, the photoreceptor is not limited to the drum-shaped photoreceptor, and sheet-shaped photoreceptors and endless belt photoreceptors can also be used. A laser beam L irradiates the photoreceptor to form an electrostatic latent image on the photoreceptor.

Around the photoreceptor 1, the following members are provided:

(1) a discharge lamp 2 configured to decrease the charge remaining on the photoreceptor 1;

(2) a charger 3 configured to charge the entire surface of the photoreceptor 1;

(3) an eraser 4 configured to erase the charge of an area which is unnecessary for the image to be produced, (4) an imagewise light irradiator 5 configured to irradiate the photoreceptor with imagewise light to form an electrostatic latent image, (5) a developing unit 6 configured to develop the electrostatic latent image with a developer to form a toner image on the photoreceptor, (6) a pre-transfer charger 7, a transfer charger 10 and a separation charger 11, configured to easily transfer the toner image on a receiving material 9 which is timely fed to the transfer position by a pair of registration rollers 8 and 8;

(7) a separation pick 12 configured to separate the receiving material 9 from the photoreceptor 1 after image transferring; and (8) a pre-cleaning charger 13, a fur brush 14 and a cleaning blade 15 which constitute a cleaner and which remove the toner remaining on the surface of the photoreceptor 1 after image transferring.

Known chargers such as corotrons, scorotrons, solid state chargers, charging rollers or the like chargers can be used for the charger 3, pre-transfer charger 7, transfer charger 10, separation charger 11 and pre-cleaning charger 13. A combination of the transfer charger 10 with the separation charger 12 is preferably used for the image transfer device, but only a transfer charger can also be used for the image transfer device.

Then the imagewise light irradiator 5 will be explained in detail. As illustrated in FIG. 1, the photoreceptor 1 is rotated in a direction (i.e., a sub-scanning direction of the laser light L) indicated by an arrow A. The laser light L imagewise irradiates the photoreceptor 1 (i.e., a light spot is formed on the photoreceptor 1) while scanning in a main scanning direction (i.e., a direction vertical to the sub-scanning direction, namely the direction perpendicular to the drawing sheet). Thus, a latent image is formed on the photoreceptor 1. The operation of the imagewise light irradiator 5 is performed by a laser beam writing device.

Figure 2:
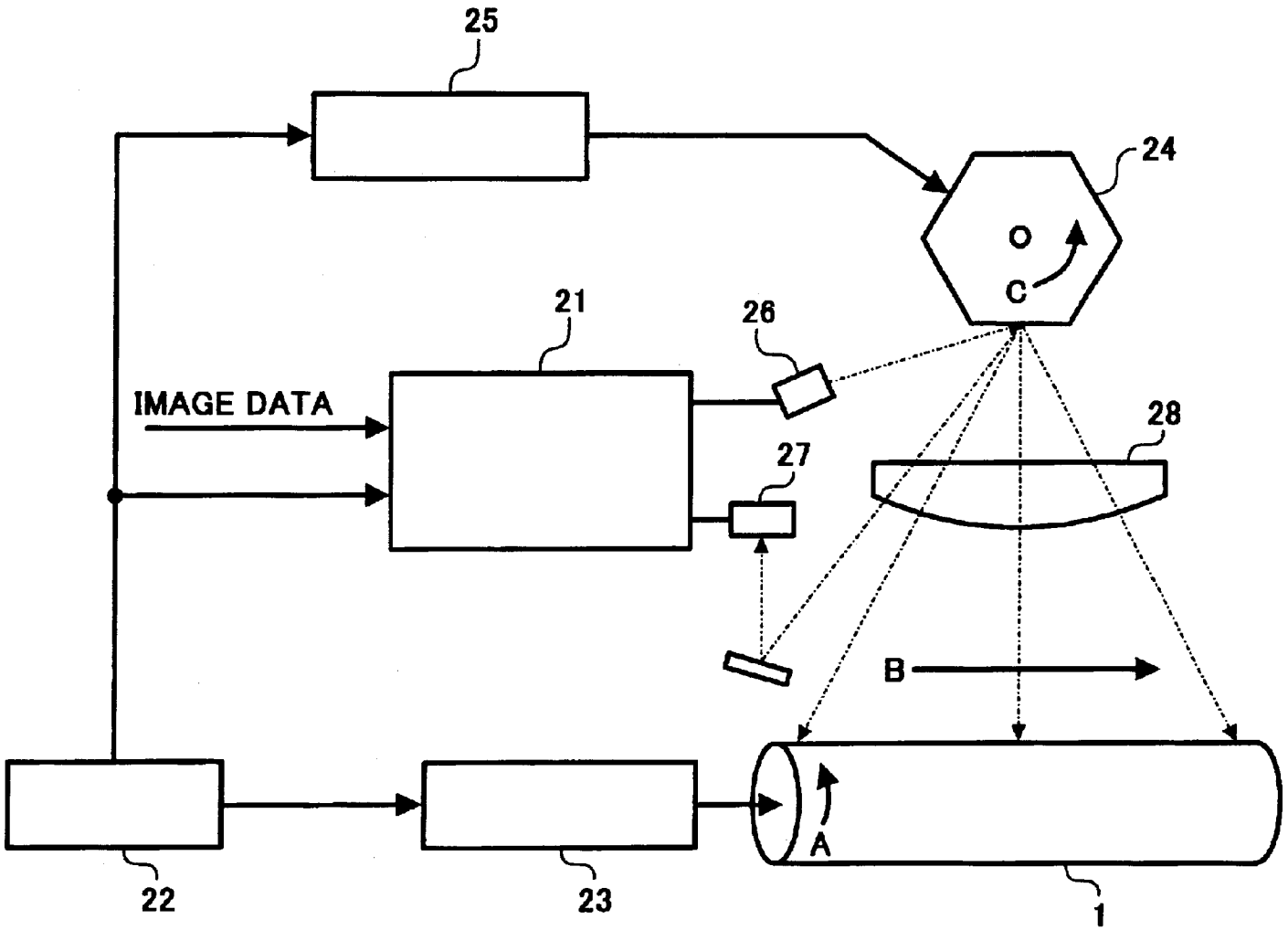
FIG. 2 is a schematic view illustrating an imagewise light irradiating device for use in the image forming apparatus of the present invention.

FIG. 2 is a schematic view illustrating an embodiment of the laser beam writing device.

Referring to FIG. 2, the laser beam writing device includes a printer controller 22, and an image writing controller 21, a polygon motor controller 25 and a stepping motor controller 23, which are controlled by the printer controller 22.

The image writing controller 21 controls lighting of a laser diode 26 according to the image data sent from the printer controller 22. The laser beam emitted by the laser diode 26 passes through a focussing optical device (not shown in FIG. 2) and is deflected by a polygon mirror 24, which is rotated in a direction C at a constant speed by a polygon motor controller 25. Then, the laser beam is focussed on the photoreceptor 1 by a fθ lens 28 to form a light spot having a small diameter on the photoreceptor 1. The laser beam is scanned in the main scanning direction indicated by an arrow B. Thus, the light beam writing operation is performed.

The writing in the main scanning direction B is started according to the timing signal LGATE which is generated according to the synchronized signal generated when detecting the light beam with a synchronization detecting sensor 27. The writing in the sub-scanning direction A is started according to the timing signal such that the light beam irradiates the photoreceptor 1 from the standard position in the rotation direction thereof, wherein the rotation of the photoreceptor 1 is controlled by the stepping motor controller 23.

In the image writing controller 21, modulation signals which control lighting of the laser diode 26 are generated according to the image data which are the source of the image to be written and which are sent from an image input device (e.g., scanners, and printer controllers which receive image data generated outside through an interface). A LD driver drives the laser diode 26 according to the modulation signals, resulting in emission of imagewise light.

In this case, the laser beam emitted by the laser diode 26 irradiates the photoreceptor 1 to form a light spot thereon, i.e., to from a latent image. Therefore, the modulation signals suitable for this process are generated to control the lighting of the laser diode 26.

When the image density of images is changed or half tone images are formed, a method in which recording density of the light spots is changed while the diameter of the light spot is fixed or a method in which scanning is performed while the diameter of light spots is changed, is typically used. The modulation of light emission is performed depending on the method adopted. In the latter method, a modulation method in which the light emission is modulated by the lighting time (i.e., pulse width modulation, PWM modulation) or a strength modulation method can be used.

As the light source for emitting laser light L, various laser diodes which emit laser light having different wavelength can be used. In the case of the light source for use in the imagewise irradiation, the smaller the diameter of the light spot, the better the image qualities of the resultant image. Therefore, laser light having a short wavelength is preferably used therefor.

When laser diodes emitting laser light having different wavelength are used for writing, the minor axis diameter (L) of the light spot formed on the photoreceptor preferably fulfills the following relationship (1):

$$0.1<3.75\times10^{-3}L/\lambda<d/\lambda<0.5 \quad (1)$$

wherein λ represents the wavelength of the laser light and d represents the average particle diameter of the inorganic filler included in the protective layer of the photoreceptor used.

In order to fulfill the relationship (1), lighting of the laser diode is adjusted and controlled by the image writing controller 21. Specifically, the conditions of the PWM modulation or strength modulation are changed to adjust the minor axis diameter of the light spot. Alternatively, the positions of the elements constituting the optical scanning device are adjusted to change the focussing conditions of the laser light, and thereby the minor axis diameter of the light spot is adjusted.

Hereinbefore, an embodiment of the image forming apparatus is explained referring to FIG. 1, but the image forming apparatus can be modified. For example, light irradiation may be performed in the image transfer process, discharging process and cleaning process and pre-irradiation process.

In addition, when the toner image formed on the photoreceptor 1 by the developing units 6 is transferred onto the receiving material 9, all of the toner image is not transferred onto the receiving material 9 which is fed by a pair of registration rollers 8, and toner particles remain on the surface of the photoreceptor 1. The residual toner particles are removed from the photoreceptor 1 by the fur brush 14 and the cleaning blade 15. The cleaning operation may be performed only by a cleaning brush such as fur brushes and mag-fur brushes.

When the photoreceptor 1 which is previously charged positively (or negatively) is exposed to imagewise light, an electrostatic latent image having a positive or negative charge is formed on the photoreceptor 1. When the latent image having a positive (or negative) charge is developed with a toner having a negative (or positive) charge, a positive image can be obtained. In contrast, when the latent image having a positive (negative) charge is developed with a toner having a positive (negative) charge, a negative image (i.e., a reversal image) can be obtained. As the developing method, known developing methods can be used. In addition, as the discharging method, known discharging methods can also be used.

The above-mentioned image forming unit illustrated in FIG. 1 may be fixedly set in an image forming apparatus such as copiers, facsimiles or printers. However, the image forming unit may be set therein as a process cartridge. The process cartridge means an image forming unit (or device) which includes a photoreceptor, and at least one of a charger, an image irradiator, an image developer, an image transfer device, a cleaner, and a discharger and which can be attached to or detached from an image forming apparatus.

Figure 3:
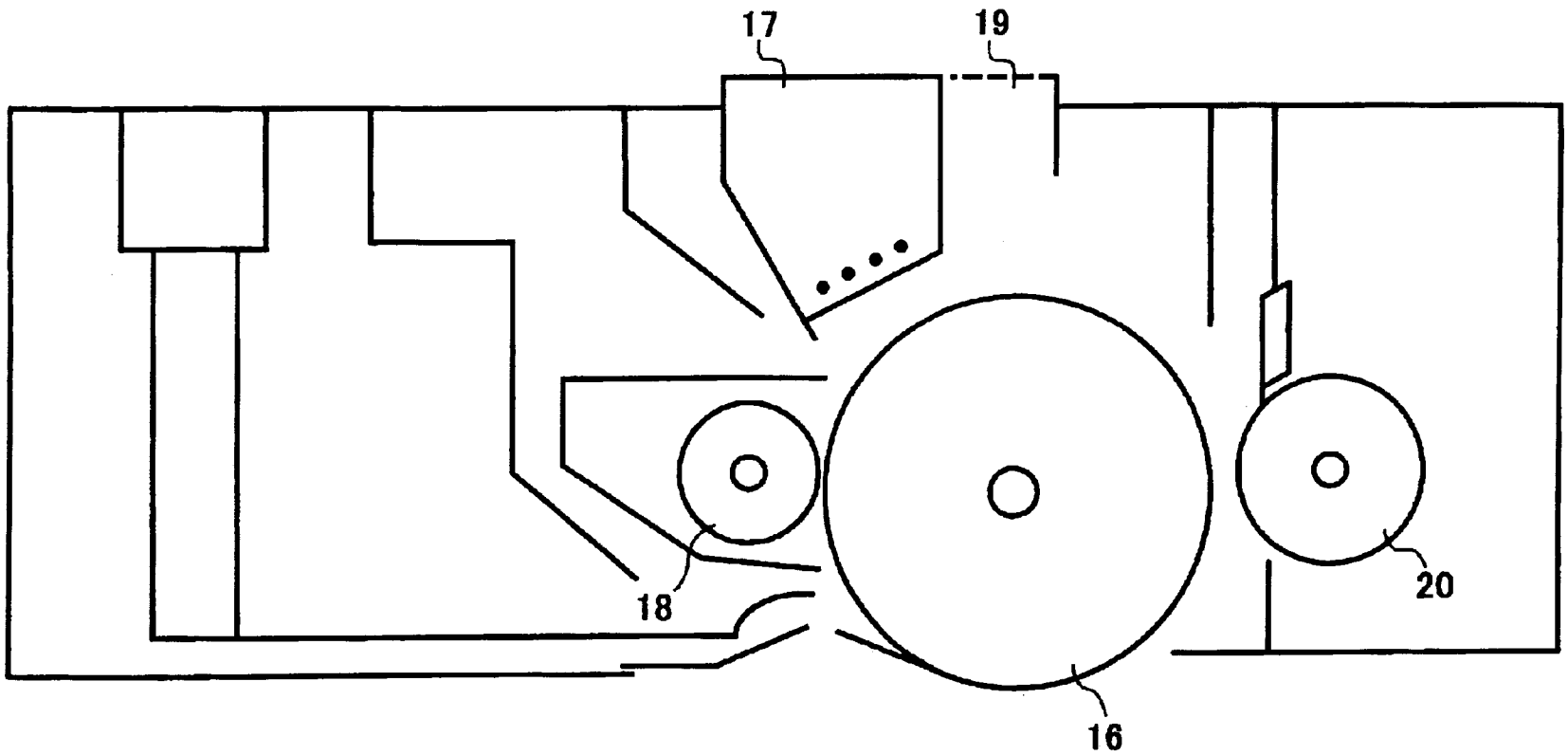
FIG. 3 is a schematic view illustrating another embodiment of the image forming apparatus of the present invention.

Various process cartridges can be used in the present invention. An embodiment of the process cartridge of the present invention is illustrated in FIG. 3. In FIG. 3, numeral 16 denotes a photoreceptor. Around the photoreceptor 16, a charger 17, an opening 19 through which a laser beam irradiates the surface of the photoreceptor 16, a developing section including a developing roller 20, an image transfer section, and a cleaner including a cleaning brush 18 are arranged.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following components were mixed and dispersed using a ball mill to prepare an undercoat layer coating liquid.

Undercoat Layer Coating Liquid

| | |
|---|---|
| Alkyd resin (BEKKOZOLE 1307-60-EL from Dainippon Ink & Chemicals, Inc.) | 6 |
| Melamine resin (SUPPER BEKKAMINE G-821-60 from Dainippon Ink & Chemicals, Inc.) | 4 |
| Titanium oxide (CR-EL from Ishihara Sangyo Kaisha Ltd.) | 40 |
| Methyl ethyl ketone | 200 |

The undercoat layer coating liquid was coated by a dip coating method on an aluminum drum having a diameter of 30 mm which serves as an electroconductive substrate and then dried upon application of heat thereto. Thus, an undercoat layer having a thickness of 3.5 $\mu$m was prepared.

Then the following components were mixed and dispersed using a ball mill to prepare a charge generation layer coating liquid.

Charge Generation Layer Coating Liquid

| | |
|---|---|
| Disazo compound having the following formula (10) | 5 |

(10)

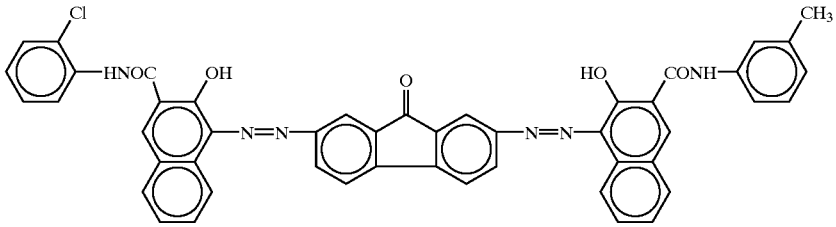

| | |
|---|---|
| Polyvinyl butyral (S-LEC BL-S from Sekisui Chemical Co., Ltd.) | 1.5 |
| Cyclohexanone | 120 |
| Methyl ethyl ketone | 120 |

The charge generation layer coating liquid was coated on the undercoat layer by a dip coating method and then dried upon application of heat thereto. Thus, a charge generation layer coating liquid having a thickness of 0.2 $\mu$m was prepared.

Next, the following components were mixed to prepare a charge transport layer coating liquid.

Charge Transport Layer Coating Liquid

| | |
|---|---|
| Charge transport material having the following formula (11) (ionization potential of 5.50 eV) | 7 |

(11)

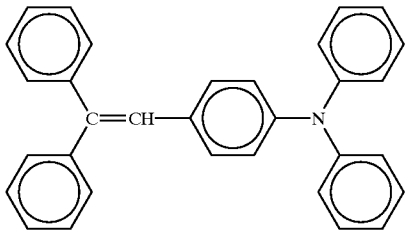

-continued

| | |
|---|---|
| Polycarbonate resin (Z-form polycarbonate having a viscosity average molecular weight Mv of 50,000, from Teijin Chemicals Ltd.) | 10 |
| Methylene chloride | 100 |
| 1% methylene chloride solution of silicone oil (silicone oil: KF50 from Shin-Etsu Silicone Co., Ltd.) | 1 |

The charge transport layer coating liquid was coated on the charge generation layer by a dip coating method and then dried upon application of heat thereto. Thus, a charge transport layer having a thickness of 19 $\mu$m was prepared.

The following components were mixed and dispersed for 96 hours using a ball mill which includes a hard glass pot having a diameter of 9 cm and zirconia beads having a diameter of 2 mm contained in the glass pot, to prepare a protective layer coating liquid.

Protective Layer Coating Liquid

| | |
|---|---|
| Polycarbonate resin (Z-form polycarbonate having a viscosity average molecular weight Mv of 50,000, from Teijin Chemicals Ltd.) | 5 |
| Alumina (from Sumitomo Chemical Co., Ltd.) | 2 |
| Charge transport material having the following formula (12) (ionization potential of 5.39 eV) | 3 |

(12)

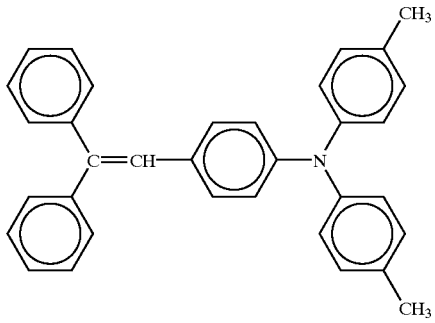

| | |
|---|---|
| Cyclohexanone | 200 |

The protective layer coating liquid was coated on the charge transport layer by a spray coating method and then dried upon application of heat thereto. Thus, a protective layer having a thickness of 2.5 μm was prepared. The average particle diameter of the alumina dispersed in the protective layer was also 0.3 μm when measured by observing the cross section of the protective layer with a transmission electron microscope.

Thus, a photoreceptor (1) was prepared.

Evaluation of Photoreceptor

The photoreceptor (1) was set in an electrophotographic copier which was prepared by modifying the optical devices of IMAGIO MF2200 manufactured by Ricoh Co., Ltd. such that a laser having a wavelength of 655 nm is used as the image writing laser beam and the light spot formed on the photoreceptor can be changed. Then a running test in which 120,000 images were produced was performed.

In Example 1, the photoreceptor was evaluated while the minor axis diameter of the light spot was set to be 70 μm. The evaluation items are as follows:

(1) Abrasion Amount (Decrease in Thickness)

The thickness of the photoreceptor (1) was measured with an Eddy current thickness meter FISHERSCOPE MMS to determine the abrasion amount (decrease in thickness) of the surface of the photoreceptor.

(2) Electric Potential (Residual Potential)

The photoreceptor was charged so as to have a potential of −600V. Then the surface of the photoreceptor was exposed to the laser light mentioned above to measure the residual potential VL (i.e., the potential of the lighted area).

(3) Image Qualities

The produced images were visually observed to determine whether the image density of a solid image is proper, and there are background fouling such as black spots and fogging, and abnormal images, i.e., to evaluate the total image qualities. The image qualities were evaluated while classified into the following three grades:

A: good
B: slightly poor
C: poor (4) Resolution

An image in which single dots were formed at a density of 1200 dpi was formed. The image was observed with a microscope to determine the reproducibility of the single dots. The quality was classified into the following three grades:

A: resolution is good.
B: resolution is slightly deteriorates.
C: resolution is poor.

(5) Fine Line Reproducibility

An image including fine lines was formed. The image was visually observed. The quality was classified into the following three grades:

A: fine line reproducibility is good.
B: fine line reproducibility slightly deteriorates.
C: fine line reproducibility is poor.

The results are shown in Table 1.

Example 2

The procedures for preparation and evaluation of the photoreceptor (1) in Example 1 were repeated except that the minor axis diameter of the light spot formed on the photoreceptor was changed to 50 μm.

The evaluation results are shown in Table 1.

Example 3

The procedures for preparation and evaluation of the photoreceptor (1) in Example 1 were repeated except that the minor axis diameter of the light spot formed on the photoreceptor was changed to 20 μm.

The evaluation results are shown in Table 1.

TABLE 1

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 1 | 0.40 | 0.46 | 160 | A | A | A | 1.3 |
| Ex. 2 | 0.29 | 0.46 | 140 | A | A | A | 1.3 |
| Ex. 3 | 0.11 | 0.46 | 140 | A | A | A | 1.3 |

Example 4

The procedure for preparation of the photoreceptor (1) was repeated except that the alumina included in the protective layer coating liquid was replaced with titanium oxide (manufactured by Ishihara Sangyo Kaisha Ltd.) and the dispersing conditions of the protective layer coating liquid were changed such that the zirconia beads having a diameter of 2 mm were replaced with PSZ balls having a diameter of 5 mm and the dispersion time was changed from 96 to 120 hours.

Thus, a photoreceptor (2) was prepared. The average particle diameter of the titanium oxide in the resultant protective layer was also 0.25 μm, when measured by observing the cross section of the protective layer with the transmission electron microscope.

Example 5

The procedure for preparation of the photoreceptor (1) was repeated except that the alumina included in the protective layer coating liquid was replaced with silica (manufactured by Nippon Aerosil Co.) and the dispersing conditions of the protective layer coating liquid were changed such that the zirconia beads having a diameter of 2 mm were replaced with alumina balls having a diameter of 1 cm and the dispersion time was changed from 96 to 144 hours.

Thus, a photoreceptor (3) was prepared. The average particle diameter of the silica in the resultant protective layer was also 0.20 μm, when measured by observing the cross section of the protective layer with the transmission electron microscope.

The thus prepared photoreceptors (2) and (3) were also evaluated in the same way as performed in Example 2 (i.e., the minor axis diameter of the light spot was 50 μm).

The evaluation results are shown in Table 2.

TABLE 2

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 3 | 0.29 | 0.38 | 150 | A | A | A | 1.5 |
| Ex. 4 | 0.29 | 0.31 | 140 | A | A | A | 1.8 |

Example 6

The procedure for preparation of the photoreceptor (1) was repeated except that the charge generation layer coating liquid was replaced with the following charge generation layer coating liquid.

Charge Generation Layer Coating Liquid

| | |
|---|---|
| Y-form oxytitanylphthalocyanine | 8 |
| Polyvinyl butyral | 5 |
| 2-butanone | 400 |

Thus, a photoreceptor (4) was prepared.

The photoreceptor (4) was evaluated in the same way as performed in Example 1 except that a laser having a wavelength of 780 nm was used as the image writing light and the minor axis diameter of the light spot formed on the photoreceptor was 75 μm.

Example 7

The procedures for preparation and evaluation of the photoreceptor (4) in Example 6 were repeated except that the minor axis diameter of the light spot formed on the photoreceptor was changed to 60 μm.

The evaluation results are shown in Table 3.

Example 8

The procedures for preparation and evaluation of the photoreceptor (4) in Example 6 were repeated except that the minor axis diameter of the light spot formed on the photoreceptor was changed to 20 μm.

The evaluation results are shown in Table 3.

TABLE 3

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 6 | 0.36 | 0.38 | 170 | A | A | A | 1.3 |
| Ex. 7 | 0.29 | 0.38 | 180 | A | A | A | 1.3 |
| Ex. 8 | 0.14 | 0.38 | 170 | A | A | A | 1.3 |

Example 9

The procedure for preparation of the photoreceptor (4) in Example 6 was repeated except that the alumina included in the protective layer coating liquid was replaced with titanium oxide (manufactured by Ishihara Sangyo Kaisha Ltd.) and the dispersing conditions of the protective layer coating liquid were changed such that the zirconia beads having a diameter of 2 mm were replaced with PSZ balls having a diameter of 5 mm and the dispersion time was changed from 96 to 120 hours.

Thus, a photoreceptor (5) was prepared. The average particle diameter of the titanium oxide in the resultant protective layer was also 0.25 μm, when measured by observing the cross section of the protective layer with the transmission electron microscope.

Example 10

The procedure for preparation of the photoreceptor (4) was repeated except that the alumina included in the protective layer coating liquid was replaced with silica (manufactured by Nippon Aerosil Co.) and the dispersing conditions of the protective layer coating liquid were changed such that the zirconia beads having a diameter of 2 mm were replaced with alumina balls having a diameter of 1 cm and the dispersion time was changed from 96 to 144 hours.

Thus, a photoreceptor (6) was prepared. The average particle diameter of the silica in the resultant protective layer was also 0.20 μm, when measured by observing the cross section of the protective layer with the transmission electron microscope.

The thus prepared photoreceptors (5) and (6) were also evaluated in the same way as performed in Example 6 except that the minor axis diameter of the light spot was changed to 50 μm.

The results are shown in Table 4.

TABLE 4

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 9 | 0.24 | 0.32 | 170 | A | A | A | 1.5 |
| Ex. 10 | 0.24 | 0.26 | 160 | A | A | A | 1.8 |

Example 11

The procedure for preparation of the photoreceptor (1) in Example 1 was repeated except that the charge transport material was removed from the protective layer coating liquid.

Thus, a photoreceptor (7) was prepared.

Example 12

The procedure for preparation of the photoreceptor (1) in Example 1 was repeated except that a single-layered photosensitive layer having a thickness of 25 μm was formed instead of the multi-layered photosensitive layer of the charge generation layer and charge transport layer. The photosensitive layer coating liquid was prepared as follows.

The following components were mixed and dispersed using a ball mill.

Photosensitive Layer Coating Liquid

| | |
|---|---|
| Disazo compound having formula (10) | 5 |
| Charge transport material having formula (12) | 50 |
| Z-form polycarbonate resin (molecular weight of 60,000) | 97 |
| Tetrahydrofuran | 328 |

Thus, a photoreceptor (8) was prepared.

Example 13

The procedure for preparation of the photoreceptor (1) in Example 1 was repeated except that the charge transport material included in the charge transport layer was replaced with 7 parts of the charge transport material having formula (12).

Thus, a photoreceptor (9) was prepared.

Example 14

The procedure for preparation of the photoreceptor (1) in Example 1 was repeated except that the charge transport material included in the protective layer was replaced with a charge transport material which has an ionization potential of 5.3 eV and which has the following formula (13).

(13)

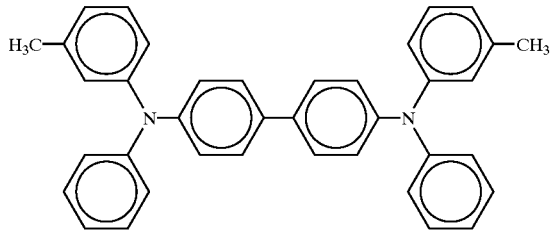

Thus, a photoreceptor (10) was prepared.

Example 15

The procedure for preparation of the photoreceptor (1) in Example 1 was repeated except that the charge transport material included in the charge transport layer was replaced with 3 parts of the charge transport material having formula (11).

Thus, a photoreceptor (11) was prepared.

Example 16

The procedure for preparation of the photoreceptor (1) in Example 1 was repeated except that the binder resin included in the protective layer was replaced with a polyarylate resin U100 manufactured by Unitika Ltd.

Thus, a photoreceptor (12) was prepared.

The thus prepared photoreceptors (7) to (12) were also evaluated in the same way as performed in Example 2 (i.e., the minor axis diameter of the light spot was 50 μm).

The evaluation results are shown in Table 5.

TABLE 5

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 11 | 0.29 | 0.46 | 200 | A | A | A | 0.9 |
| Ex. 12 | 0.29 | 0.46 | 130 | A | A | A | 1.3 |
| Ex. 13 | 0.29 | 0.46 | 150 | A | A | A | 1.5 |
| Ex. 14 | 0.29 | 0.46 | 160 | A | A | A | 1.4 |
| Ex. 15 | 0.29 | 0.46 | 140 | A | A | A | 1.3 |
| Ex. 16 | 0.29 | 0.46 | 140 | A | A | A | 1.7 |

Example 17

The procedure for preparation of the undercoat layer was repeated to prepare an aluminum drum which has a diameter of 30 mm and which has an undercoat layer having a thickness of 3.5 μm on the aluminum drum.

The following components were mixed and dispersed using a ball mill to prepare a charge generation layer coating liquid.

Charge Generation Layer Coating Liquid

| | |
|---|---|
| Y-form oxotitanium phthalocyanine | 1.5 |
| Polyvinyl butyral (S-LEC BLS from Sekisui Chemical Co., Ltd.) | 1 |
| Cyclohexanone | 220 |
| Methyl ethyl ketone | 220 |

The charge generation layer coating liquid was coated on the undercoat layer by a dip coating method and then dried to prepare a charge generation layer of 0.2 μm.

The following components were mixed to prepare a charge transport layer coating liquid.

Charge Transport Layer Coating Liquid

Charge transport material having the following formula (14)

(14)

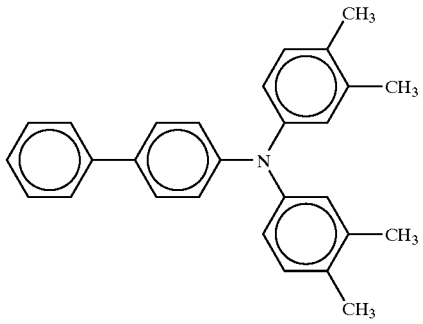

| | |
|---|---|
| Z-form polycarbonate resin (viscosity average molecular weight Mv of 50,000, from Teijin Chemicals Ltd.) | 10 |
| Methylene chloride | 100 |
| 1% methylene chloride solution of silicone oil (silicone oil: KF50 from Shin-Etsu Silicone Co., Ltd.) | 1 |

The charge transport layer coating liquid was coated on the charge generation layer by a dip coating method and then dried upon application of heat thereto. Thus, a charge transport layer having a thickness of 19 μm was prepared.

The following components were mixed and dispersed for 48 hours using a ball mill which includes a hard glass pot having a diameter of 9 cm and alumina balls having a diameter of 1 cm contained in the glass pot, to prepare a protective layer coating liquid.

Protective Layer Coating Liquid

| | |
|---|---|
| Polycarbonate resin (Z-form polycarbonate having a viscosity average molecular weight Mv of 50,000, from Teijin Chemicals Ltd.) | 5 |
| Alumina (from Sumitomo Chemical Co., Ltd.) | 2 |
| Charge transport material having formula (14) | 3 |
| Cyclohexanone | 200 |

The protective layer coating liquid was coated on the charge transport layer by a spray coating method and then dried upon application of heat thereto. Thus, a protective layer having a thickness of 2.6 μm was prepared. The average particle diameter of the alumina dispersed in the protective layer was also 0.20 μm when measured by observing the cross section of the protective layer with a transmission electron microscope.

Thus, a photoreceptor (13) was prepared.

The thus prepared photoreceptor (13) was also evaluated in the same way as performed in Example 1 except that the minor axis diameter (L) of the light spot was 15 μm and the wavelength of the laser beam used was 405 nm.

The evaluation results are shown in Table 6.

TABLE 6

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Ex. 11 | 0.14 | 0.49 | 130 | A | A | A | 1.3 |

Comparative Example 1

The procedure for preparation of the photoreceptor (1) in Example 1 was repeated except that the alumina included in the protective layer coating liquid was removed therefrom.

Thus, a comparative photoreceptor (1) was prepared.

The comparative photoreceptor (1) was evaluated in the same way as performed in Example 2 (i.e., the minor axis diameter of the light spot was 50 μm).

The evaluation results are shown in Table 7.

TABLE 7

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Comp. Ex. 1 | 0.29 | — | 200 | C | A | C | 6.8 |

As can be understood from the comparison of the evaluation results of the comparative photoreceptor (1) (Comparative Example 1) with those of the photoreceptor (1) (Example 2), the comparative photoreceptor (1) is inferior to the photoreceptor (1) in view of the abrasion resistance and the residual potential VL. Therefore, the images produced by the comparative photoreceptor (1) have poor image qualities and poor fine line reproducibility. This is because the protective layer of the comparative photoreceptor (1) does not include alumina.

Comparative Example 2

The procedure for preparation of the photoreceptor (1) in Example 1 was repeated except that the dispersing conditions of the protective layer coating liquid were changed such that the zirconia beads having a diameter of 2 mm were replaced with PSZ balls having a diameter of 2 mm and the dispersion time was changed from 96 to 24 hours.

Thus, a comparative photoreceptor (2) was prepared. The average particle diameter of the alumina in the resultant protective layer was also 0.50 μm, when measured by observing the cross section of the protective layer with the transmission electron microscope whereas the average particle diameter of the alumina in the protective layer of the photoreceptor (1) was 0.30 μm.

The comparative photoreceptor (2) was evaluated in the same way as performed in Example 2 (i.e., the minor axis diameter of the light spot was 50 μm).

The evaluation results are shown in Table 8.

TABLE 8

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Comp. Ex. 2 | 0.29 | 0.76 | 270 | C | A | C | 1.1 |

As can be understood from the comparison of the evaluation results of the comparative photoreceptor (2) (Comparative Example 2) with those of the photoreceptor (1) (Example 2), the comparative photoreceptor (2) is inferior to the photoreceptor (1) in view of the residual potential VL. In addition, since the value d/λ is 0.76, which largely exceeds 0.5, the images produced by the comparative photoreceptor (2) have poor image qualities and poor fine line reproducibility. This is because the value of d/λ exceeds 0.5.

Comparative Example 3

The procedures for preparation and evaluation of the photoreceptor (1) in Example 1 were repeated except that the minor axis diameter of the light spot was changed to 85 μm.

The evaluation results are shown in Table 9.

TABLE 9

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Comp. Ex. 3 | 0.49 | 0.46 | 170 | A | C | B | 1.1 |

As can be understood from the comparison of the evaluation results of the comparative photoreceptor (3) (Comparative Example 3) with those of the photoreceptor (1) (Example 1), the comparative photoreceptor (3) is inferior to the photoreceptor (1) in view of the residual potential VL. In addition, since the value of $3.75\times10^{-3}L/\lambda$ is 0.49, which exceeds the value of d/λ (0.46), the images produced by the comparative photoreceptor (3) have poor resolution and the fine line reproducibility of the produced images slightly deteriorates. This is because the comparative photoreceptor (3) does not fulfill the following relationship:

$$3.75\times10^{-3}L/\lambda<d/\lambda.$$

Comparative Example 4

The procedure for preparation of the photoreceptor (1) in Example 1 was repeated except that the dispersing conditions of the protective layer coating liquid were changed the zirconia beads having a diameter of 2 mm were replaced with stainless balls having a diameter of 1 cm and the dispersion time was changed from 96 to 179 hours.

Thus, a comparative photoreceptor (4) was prepared. The average particle diameter of the alumina in the resultant protective layer was also 0.10 μm, when measured by observing the cross section of the protective layer with the transmission electron microscope whereas the average particle diameter of the alumina in the protective layer of the photoreceptor (1) was 0.30 μm.

The comparative photoreceptor (4) was evaluated in the same way as performed in Example 2 (i.e., the minor axis diameter of the light spot was 50 μm).

The evaluation results are shown in Table 10.

TABLE 10

| | $3.75 \times 10^{-3}$ L/λ | D/λ | VL (−V) | Image qualities | Resolution | Fine line reproducibility | Abrasion amount (μm) |
|---|---|---|---|---|---|---|---|
| Comp. Ex. 2 | 0.29 | 0.15 | 150 | C | A | B | 3.4 |

As can be understood from the comparison of the evaluation results of the comparative photoreceptor (4) (Comparative Example 2) with those of the photoreceptor (1) (Example 2), the comparative photoreceptor (4) is inferior to the photoreceptor (1) in view of the abrasion resistance (i.e., the comparative photoreceptor (4) has poor durability). In addition, since the value of d/λ is 0.15, which is much lower than the value of $3.75\times10^{-3}$L/λ (0.29), the images produced by the comparative photoreceptor (4) have poor image qualities and the fine line reproducibility thereof slightly deteriorates. This is because the comparative photoreceptor (4) does not fulfill the following relationship:

$$3.75\times10^{-3}L/\lambda<d/\lambda.$$

Comparative Example 5

The procedures for preparation and evaluation of the photoreceptor (1) in Example 1 were repeated except that the minor axis diameter of the light spot formed on the photoreceptor was changed to 10 μm.

The evaluation results are shown in Table 11.

TABLE 11

| | 3.75 x $10^{-3}$ L/λ | D/λ | VL (−V) | Image qualities | Resolution | Fine line reproducibility | Abrasion amount (μm) |
|---|---|---|---|---|---|---|---|
| Comp. Ex. 10 | 0.06 | 0.46 | 160 | A | A | C | 1.3 |

As can be understood from the comparison of the evaluation results of the comparative photoreceptor (5) (Comparative Example 5) with those of the photoreceptor (1) (Example 3), the comparative photoreceptor (5) is inferior to the photoreceptor (1) (Example 3) in view of the fine line reproducibility. This is because the value of $3.75\times10^{-3}$L/λ of the comparative photoreceptor (5) is 0.06 and therefore the comparative photoreceptor (5) does not fulfill the following relationship:

$$0.1<3.75\times10^{-3}L/\lambda.$$

Effects of the Present Invention (1) When the value of $3.75\times10^{-3}$L/λ, i.e., the ratio of the minor axis diameter of the light spot (L) to the wavelength (λ) of the light beam used for image irradiating is controlled so as not to be less than 0.1, the image irradiation is hardly influenced by the diffuse reflection at the surface of the photoreceptor and thereby a problem in that the fine line reproducibility deteriorates can be prevented.

In addition, when the ratio of $3.75\times10^{-3}$L/λ is controlled so as not to be greater than the ratio d/λ of the average particle diameter (d) of the filler included in the protective layer of the photoreceptor to the wavelength (λ) of the light beam, the resolution of the resultant images hardly deteriorates. In addition, the abrasion resistance and durability of the photoreceptor hardly deteriorate.

Further, when the ratio d/λ is controlled so as not to be not greater than 0.5, high quality images can be produced for a long period of time without increasing the residual potential of the photoreceptor.

Thus, by fulfilling the following relationship:

$$0.1<3.75\times10^{-3}L/\lambda<d/\lambda<0.5,$$

an image forming apparatus which has long life and high durability and which can produce high quality images can be provided.

(2) When the above-mentioned relationship is satisfied and in addition the inorganic filler included in the protective layer of the photoreceptor used has an average particle diameter of from 0.2 to 0.4 μm, the abrasion resistance and the image qualities can be further improved.

(3) When the conditions mentioned above in items (1) and (2) are satisfied and in addition the minor axis diameter (L) of the light spot is from 10 to 80 μm, the image qualities can be further improved because the image irradiation is hardly influenced by the diffuse reflection at the surface of the photoreceptor even when the minor axis diameter of the light spot is relatively small.

(4) When the conditions mentioned above in items (1) to (3) are satisfied and in addition a charge transport material is included in the protective layer, the photosensitivity of the photoreceptor can be further enhanced.

(5) When the conditions mentioned above in items (1) to (4) are satisfied and in addition the photosensitive layer of the photoreceptor used is functionally separated so as to have a charge generation layer and a charge transport layer, the photosensitivity of the photoreceptor can be further enhanced.

(6) When the conditions mentioned above in items (1) to (5) are satisfied and in addition the inorganic filler included in the protective layer is selected from the group consisting of titanium oxide, silica, alumina and mixtures thereof, the abrasion resistance of the photoreceptor can be further enhanced.

This document claims priority and contains subject matter related to Japanese Patent Application No. 2001-376852, filed on Dec. 11, 2001, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a photoreceptor which comprises an electroconductive substrate, a photosensitive layer comprising a charge generation material and a charge transport material disposed on the electroconductive substrate, and a protective layer comprising an inorganic filler having an average particle diameter (d) and a binder resin; and an imagewise light irradiator configured to irradiate the photoreceptor with a laser light beam having a wavelength (λ) while scanning the laser light beam to form light spots each having a diameter (L) in the minor axis direction thereof on a surface of the photoreceptor and to form a latent image on the photoreceptor, wherein the following relationship is satisfied:

$$0.1<3.75\times10^{-3}L/\lambda<d/\lambda<0.5.$$

2. The image forming apparatus according to claim 1, wherein the inorganic filler has an average particle diameter of from 0.2 to 0.4 μm.

3. The image forming apparatus according to claim 1, wherein the diameter (L) of the light spots is from 10 to 80 μm.

4. The image forming apparatus according to claim 1, wherein the protective layer further comprises a charge transport material.

5. The image forming apparatus according to claim 1, wherein the photosensitive layer comprises a charge generation layer comprising the charge generation material and a charge transport layer comprising the charge transport material, and wherein the charge transport layer is disposed on the charge generation layer.

6. The image forming apparatus according to claim 1, wherein the filler is selected from the group consisting of titanium oxide, silica, alumina and mixtures thereof.

7. The image forming apparatus according to claim 1, wherein the charge generation material comprises a disazo pigment having the following formula (1):

(1)

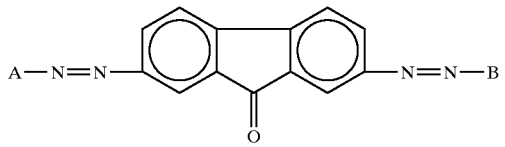

wherein A and B independently represent a residual group of a coupler, and wherein the residual group has a formula selected from the following formulae (2) to (8);

(2)

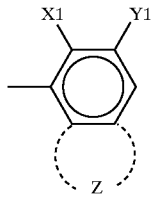

wherein X1 represents —OH, —$NHCOCH_3$, or —$NHSO_2CH_3$; Y1 represents —CON(R2) (R3), —CONHN=C(R6) (R7), —CONHN(R8) (R9), —CONHCONH (R12), a hydrogen atom, —COOH, —$COOCH_3$, —$COOC_6H_5$ or a benzimidazolyl group, wherein R2 and R3 independently represent a hydrogen atom, a substituted or unsubstituted alkyl group, a substituted or unsubstituted aryl group, a substituted or unsubstituted heterocyclic ring group, and R2 and R3 optionally form a ring with the adjacent nitrogen atom, R6 and R7 independently represent a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R6 and R7 optionally form a ring with the adjacent carbon atom, R8 and R9 independently represent a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R8 and R9 optionally form a 5-membered or 6-membered ring which optionally includes a condensed aromatic ring, and R12 represents a substituted or unsubstituted alkyl group, a substituted or unsubstituted aryl group or a substituted or unsubstituted heterocyclic ring group; and Z represents a group which forms a polycyclic aromatic ring or a polycyclic heterocyclic ring with a benzene ring, wherein each of the polycyclic aromatic ring and the polyheterocyclic ring is optionally substituted;

(3)

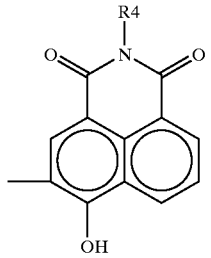

wherein R4 represents a hydrogen atom, a substituted or unsubstituted alkyl group, or a substituted or unsubstituted aryl group;

(4)

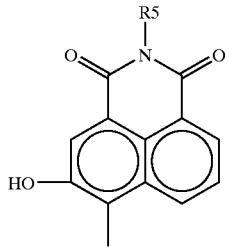

wherein R5 represents a hydrogen atom, a substituted or unsubstituted alkyl group, or a substituted or unsubstituted aryl group;

(5)

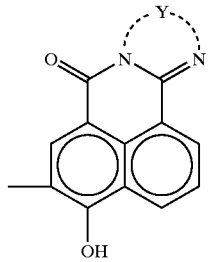

wherein Y represents a divalent aromatic hydrocarbon group or a divalent heterocyclic ring group having a nitrogen atom in the ring;

(6)

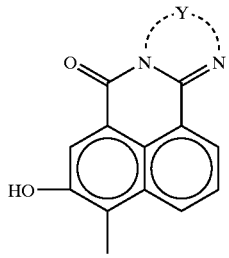

wherein Y represents a divalent aromatic hydrocarbon group, or a divalent heterocyclic ring group having a nitrogen atom in the ring;

(7)

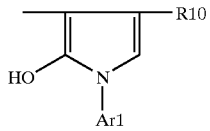

wherein R10 represents a hydrogen atom, an alkyl group having from 1 to 8 carbon atoms, a carboxyl group, or a carboxyl ester group; and Ar1 represents a substituted or unsubstituted aromatic hydrocarbon ring group; and (8)

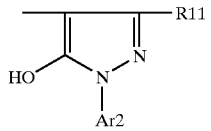

wherein R11 represents a hydrogen atom, an alkyl group having from 1 to 8 carbon atoms, a carboxyl group, or a carboxyl ester group; and Ar2 represents a substituted or unsubstituted aromatic hydrocarbon ring group.

8. The image forming apparatus according to claim 1, wherein the charge transport material comprises a compound having the following formula (9):

(9)

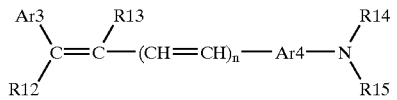

wherein R12, R13, R14 and R15 independently represent a hydrogen atom, a substituted or unsubstituted alkyl group having from 1 to 8 carbon atoms or a substituted or unsubstituted aryl group; Ar3 represents a substituted or unsubstituted aryl group; Ar4 represents a substituted or unsubstituted arylene group, wherein Ar3 and R12 optionally form a ring; and n is 0 or 1.

9. The image forming apparatus according to claim 1, wherein the wavelength (λ) of the laser light beam is from 400 to 450 nm.

10. An image forming apparatus comprising:

a process cartridge comprising:

a photoreceptor which comprises an electroconductive substrate, a photosensitive layer comprising a charge generation material and a charge transport material disposed on the electroconductive substrate, and a protective layer comprising an inorganic filler having an average particle diameter (d) and a binder resin; and at least one of a charger configured to charge the photoreceptor;

an image developer configured to develop an electrostatic latent image formed on the photoreceptor with a developer comprising a toner to form a toner image thereon; and a cleaner configured to clean a surface of the photoreceptor, and an imagewise light irradiator configured to irradiate the photoreceptor with a laser light beam having a wavelength (λ) while scanning the laser light beam to form light spots each having a diameter (L) in the minor axis direction thereof on a surface of the photoreceptor and to form the electrostatic latent image on the photoreceptor, wherein the following relationship is satisfied:

$$0.1<3.75\times10^{-3}L/\lambda<d/\lambda<0.5.$$

11. An image forming method comprising:

irradiating a surface of a photoreceptor with a laser light beam having a wavelength (λ) to form a light spot having a diameter (L) in the minor axis direction thereof on the surface of the photoreceptor, to obtain an electrostatic latent image formed on the photoreceptor; and developing said electrostatic latent image with a developer comprising a toner to form a toner image;

wherein the photoreceptor comprises an electroconductive substrate, a photosensitive layer comprising a charge generation material and a charge transport material disposed on the electroconductive substrate, and a protective layer comprising an inorganic filler having an average particle diameter (d) and a binder resin, and wherein the following relationship is satisfied:

$$0.1<3.75\times10^{-3}L/\lambda<d/\lambda<0.5.$$

12. The image forming method according to claim 11, wherein the inorganic filler has an average particle diameter of from 0.2 to 0.4 μm.

13. The image forming method according to claim 11, wherein the diameter (L) of the light spots is from 10 to 80 μm.

14. The image forming method according to claim 11, wherein the protective layer further comprises a charge transport material.

15. The image forming method according to claim 11, wherein the photosensitive layer comprises a charge generation layer comprising the charge generation material and a charge transport layer comprising the charge transport material, and wherein the charge transport layer is disposed on the charge generation layer.

16. The image forming method according to claim 11, wherein the filler comprises a material selected from the group consisting of titanium oxide, silica, alumina and mixtures thereof.

17. The image forming method according to claim 11, wherein the charge generation material comprises a disazo pigment having the following formula (1):

(1)

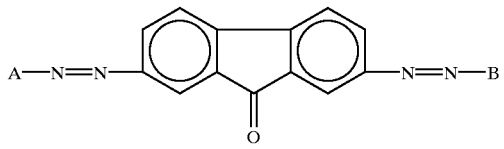

wherein A and B independently represent a residual group of a coupler, and wherein the residual group has a formula selected from the following formulae (2) to (8);

(2)

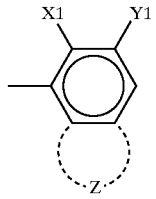

wherein X1 represents —OH, —$NHCOCH_3$, or —$NHSO_2CH_3$; Y1 represents —CON(R2) (R3), —CONHN=C(R6)(R7), —CONHN(R8)(R9), —CONHCONH(R12), a hydrogen atom, —COOH, —$COOCH_3$, —$COOC_6H_5$ or a benzimidazolyl group, wherein R2 and R3 independently represent a hydrogen atom, a substituted or unsubstituted alkyl group, a substituted or unsubstituted aryl group, a substituted or unsubstituted heterocyclic ring group, and R2 and R3 optionally form a ring with the adjacent nitrogen atom, R6 and R7 independently represent a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R6 and R7 optionally form a ring with the adjacent carbon atom, R8 and R9 independently represent a hydrogen atom, a substituted or unsubstituted alkyl group, a substituted or unsubstituted aralkyl group, a substituted or unsubstituted aryl group, a substituted or unsubstituted styryl group, a substituted or unsubstituted heterocyclic ring group, and R8 and R9 optionally form a 5-membered or 6-membered ring which optionally includes a condensed aromatic ring, and R12 represents a substituted or unsubstituted alkyl group, a substituted or unsubstituted aryl group or a substituted or unsubstituted heterocyclic ring group; and Z represents a group which forms a polycyclic aromatic ring or a polycyclic heterocyclic ring with a benzene ring, wherein the polycyclic aromatic ring and the polyheterocyclic ring are optionally substituted;

(3)

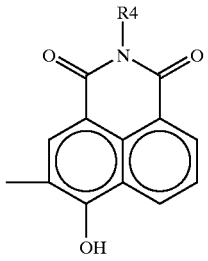

wherein R4 represents a hydrogen atom, a substituted or unsubstituted alkyl group or a substituted or unsubstituted aryl group;

(4)

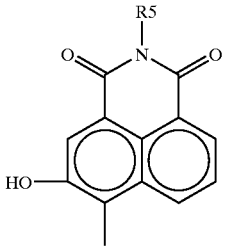

wherein R5 represents a hydrogen atom, a substituted or unsubstituted alkyl group or a substituted or unsubstituted aryl group;

(5)

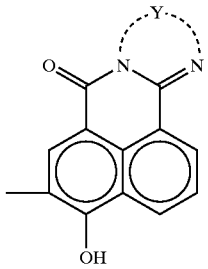

wherein Y represents a divalent aromatic hydrocarbon group or a divalent heterocyclic ring group having a nitrogen atom in the ring;

(6)

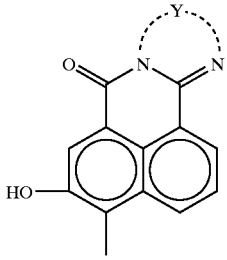

wherein Y represents a divalent aromatic hydrocarbon group or a divalent heterocyclic ring group having a nitrogen atom in the ring;

(7)

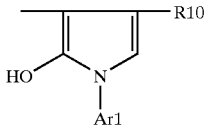

wherein R10 represents a hydrogen atom, an alkyl group having from 1 to 8 carbon atoms, a carboxyl group, or a carboxyl ester group; and Ar1 represents a substituted or unsubstituted aromatic hydrocarbon ring group; and (8)

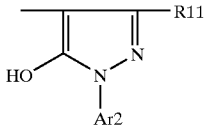

wherein R11 represents a hydrogen atom, an alkyl group having from 1 to 8 carbon atoms, a carboxyl group, or a carboxyl ester group; and Ar2 represents a substituted or unsubstituted aromatic hydrocarbon ring group.

18. The image forming method according to claim 11, wherein the charge transport material comprises a compound having the following formula (9):

(9)

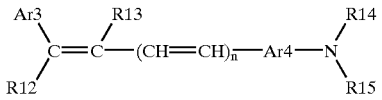

wherein R12, R13, R14 and R15 independently represent a hydrogen atom, a substituted or unsubstituted alkyl group having from 1 to 8 carbon atoms or a substituted or unsubstituted aryl group; Ar3 represents a substituted or unsubstituted aryl group; Ar4 represents a substituted or unsubstituted arylene group, wherein Ar3 and R12 optionally form a ring; and n is 0 or 1.

19. The image method according to claim 11, wherein the wavelength (λ) of the laser light beam is from 400 to 450 nm.

20. The image forming apparatus of claim 1, wherein the photoreceptor further comprises an undercoat layer comprising a resin and an optional fine powder disposed between the electroconductive substrate and the photosensitive layer.

21. The image forming apparatus of claim 10, wherein the photoreceptor further comprises an undercoat layer comprising a resin and an optional fine powder disposed between the electroconductive substrate and the photosensitive layer.

22. The image forming method of claim 11, wherein the photoreceptor further comprises an undercoat layer comprising a resin and an optional fine powder disposed between the electroconductive substrate and the photosensitive layer.

* * * * *